US006758280B2

(12) United States Patent
Van Rijzingen et al.

(10) Patent No.: US 6,758,280 B2
(45) Date of Patent: Jul. 6, 2004

(54) NON-SEIZE MATERIAL ATTACHMENT FOR A DRILL SLIP SYSTEM

(75) Inventors: J. W. H. Van Rijzingen, Oosterhout (NL); Rosmalen R. Roling, Osterhout (NL); David B. Mason, Anaheim, CA (US)

(73) Assignee: Varco I/P, Inc., Orange, CA (US)

( * ) Notice: Subject to any disclaimer, the term of this patent is extended or adjusted under 35 U.S.C. 154(b) by 0 days.

(21) Appl. No.: 10/264,458

(22) Filed: Oct. 4, 2002

(65) Prior Publication Data

US 2003/0102133 A1 Jun. 5, 2003

Related U.S. Application Data

(60) Provisional application No. 60/327,241, filed on Oct. 5, 2001.

(51) Int. Cl.[7] ..... E21B 23/01

(52) U.S. Cl. ..... 166/382; 166/118; 166/208

(58) Field of Search ..... 166/382, 208, 166/210, 216, 179, 118, 125, 134, 181, 191, 196

(56) References Cited

U.S. PATENT DOCUMENTS

| | | | | | |
|---|---|---|---|---|---|
| 4,646,827 | A | * | 3/1987 | Cobb | 166/88.2 |
| 4,949,786 | A | * | 8/1990 | Eckert et al. | 166/208 |
| 5,031,696 | A | * | 7/1991 | Zwiegel | 166/208 |
| 5,332,043 | A | * | 7/1994 | Ferguson | 166/379 |
| 5,595,248 | A | * | 1/1997 | Denny | 166/379 |

* cited by examiner

*Primary Examiner*—Frank Tsay
(74) *Attorney, Agent, or Firm*—Chrisite, Parker & Hale, LLP

(57) ABSTRACT

An oil or gas well slip system is provided having a slip bowl with an interactive contact surface and a slip assembly having a mating interactive contact surface for slidable engagement with the slip bowl interactive contact surface, wherein the slip bowl and the slip assembly are each comprised of a first material. A second material is attached to the interactive contact surface of either the slip bowl or the slip assembly, wherein the second material is compositionally different from the first material to prevent cold welding between the slip bowl and the slip assembly and wherein the second material has little or no tendency to dissolve into the atomic structure of the first material.

18 Claims, 4 Drawing Sheets

NON-SEIZE MATERIAL ATTACHMENT FOR A DRILL SLIP SYSTEM

CROSS-REFERENCE TO RELATED APPLICATION(S)

This application claims priority under 35 U.S.C. §119(e) to U.S. Provisional Application Serial No. 60/327,241, filed Oct. 5, 2001.

FIELD OF THE INVENTION

This invention relates to an improved apparatus and method of preventing cold working of slip assembly components, and more particularly, to an apparatus and method of applying a material to a contact surface of a slip segment or a slip bowl, to prevent cold working between the slip segment and the slip bowl.

BACKGROUND

When drilling for oil or gas, a platform is typically used to support a circular rotary table. Rotational energy is supplied to the rotary table through motors or the like, to move the rotary table in a circular fashion. The rotary table includes a central kelly bushing which provides a central opening or bore through which a drill pipe or a drill string passes. The kelly bushing typically includes four "pin holes" which receive pins on the master bushing that drives the kelly when interlocked with the kelly bushing. The rotary table, kelly, master bushing and kelly bushing are art terms which refer to the various parts of the drilling rig which impart the needed rotational force to the drill string to effect drilling. Such well drilling equipment is known in the art.

When adding or removing a drill pipe from the drill string, wedges, commonly referred to as "slips" are inserted into the rotary table central opening to engage a slip bowl. The slips wedge against the drill pipe to prevent the pipe from falling into the well bore. Often, placement of the slips is manual, and slips or slip assemblies (assemblies of a plurality of slips linked together) usually include handles for gripping and lifting by well personnel, commonly referred to as "roughnecks". Typically, rigs are equipped with such "hand slips". When a pipe is disconnected from the drill string, using a power tong or the like, the remaining portion of the drill string can be supported so that additional sections of pipe can be added to/or removed from the drill string.

A more modern and commonly used slip system, called a "power slip", includes a plurality of slip segments or slip assemblies that are retained within a slip bowl to prohibit the slips from vertical movement while the slip bowl rotates with the rotary table about the drill pipe. The slips and the bowl are configured such that outer surfaces of the slip segments contact inner surfaces of the slip bowl with sliding friction.

A problem commonly experienced by these power slip systems is that the sliding friction between the slips and the bowl tend to cause these parts to stick or seize upon rotation of the bowl about the slip. Since both the slips and the bowl are generally made from steel, the two parts, when loaded together at a combination of high contact pressure and high sliding friction, have a tendency to bond together in a process called cold welding. The more alike the atomic/elemental structures of both the parts are, the higher the probability that the parts will cold weld. Such cold welding can be catastrophic because the seized parts will tend to rotate the drill pipe with the rotary table and make disengagement of a drill pipe from the drill string improbable.

One method commonly used for reducing cold working between the slip and the slip bowl is to lubricate the parts with a lubricant, such as grease. However, this method requires that the parts be lubricated/greased frequently, typically every 20 to 30 cycles, which can be expensive and harmful to the environment.

Accordingly, there is a need for an inexpensive and environmentally safe method of treating the contact surfaces of the slips segments or the slip bowl, such that cold working between the slip segments and the slip bowl is reduced.

SUMMARY OF THE INVENTION

The present invention is directed to an oil or gas well slip system having a slip bowl with an interactive contact surface and a slip assembly having a mating interactive contact surface for slidable engagement with the slip bowl interactive contact surface, wherein the slip bowl and the slip assembly are each comprised of a first material. A second material is attached to the interactive contact surface of either the slip bowl or the slip assembly, wherein the second material is compositionally different from the first material to prevent cold welding between the slip bowl and the slip assembly, and wherein the second material has little or no tendency to dissolve into the atomic structure of the first material.

Another embodiment of the invention is directed to a method of reducing cold welding between a slip assembly and slip bowl of an oil or gas well slip system. The method includes providing a slip having an interactive contact surface, providing a slip assembly having a mating interactive contact surface for slidable engagement with the slip bowl interactive contact surface, wherein the slip bowl and the slip assembly are each formed from a first material, and attaching a second material to the interactive contact surface of either the slip bowl or the slip assembly, wherein the second material is compositionally different from the first material to prevent cold welding between the slip bowl and the slip assembly and wherein the second material has little or no tendency to dissolve into the atomic structure of the first material.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
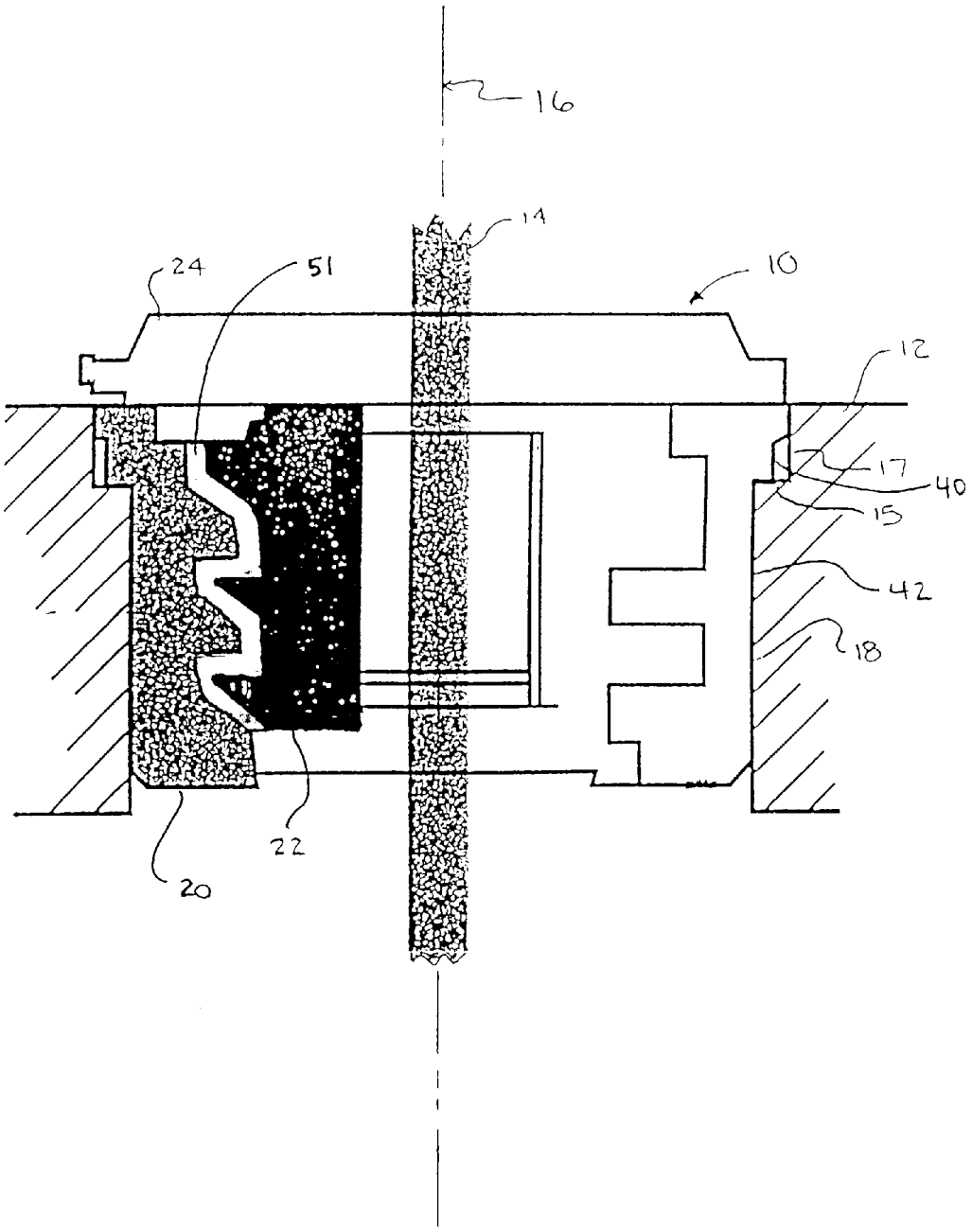
FIG. 1 is a schematic view of a power slip system in accordance with the present invention mounted onto a rotary table.

FIG. 1 illustrates a conventional rotary table 12 for suspending a drill pipe or a drill string 14, which is turned about a vertical axis 16 in a well bore. The table includes a power slip system 10 according to the present invention. The power slip system is preferably a Varco BJ® PS 21/30 power slip system. The system includes a slip bowl 20 which is mounted within a central opening 18 of the rotary table, and a slip assembly 22 which is rotatably coupled within the slip bowl. In one embodiment, the slip assembly 22 comprises a plurality of slip segments having tapered outer walls that are adapted to engage tapered inner walls of the bowl to retain the slip assembly 22 from lateral, but not rotational, movement within the bowl. Each slip segment carries along its inner surface an insert which grips the drill string to prevent the drill string from falling into the well bore. A centering device 24 is disposed on top of the bowl to center or align the drill string along the vertical axis. In one embodiment, a material 51 is applied to either the tapered outer walls of the slip segments or the tapered outer walls of the slip bowl to reduce cold working between the slip assembly and the slip bowl during drilling operations.

Figure 2:
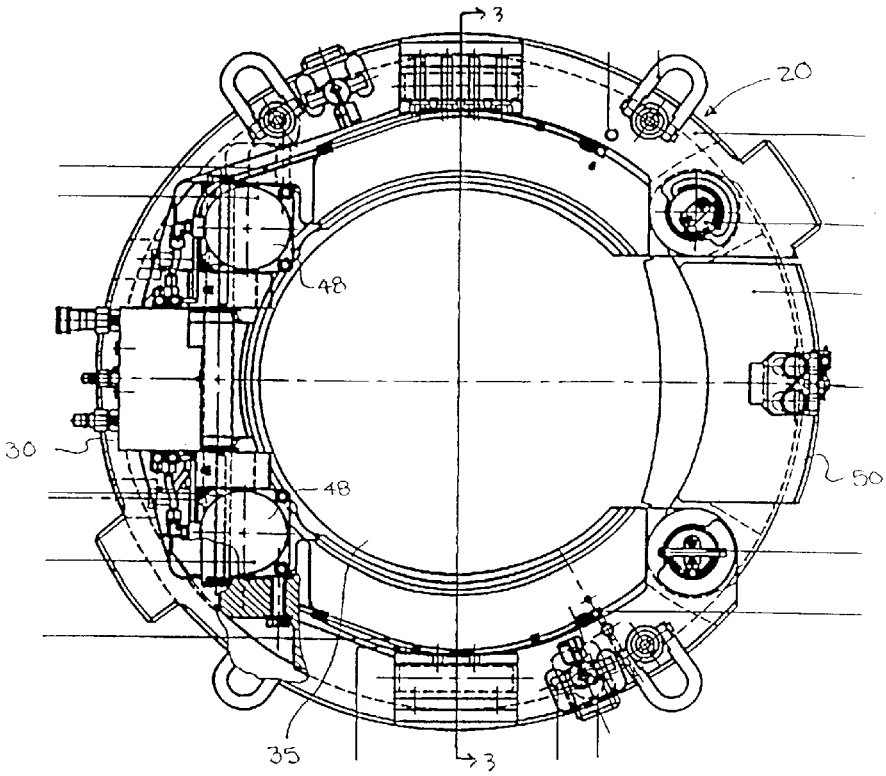
FIG. 2 is a top view of a slip bowl of the power slip system in FIG. 1.
Figure 3:
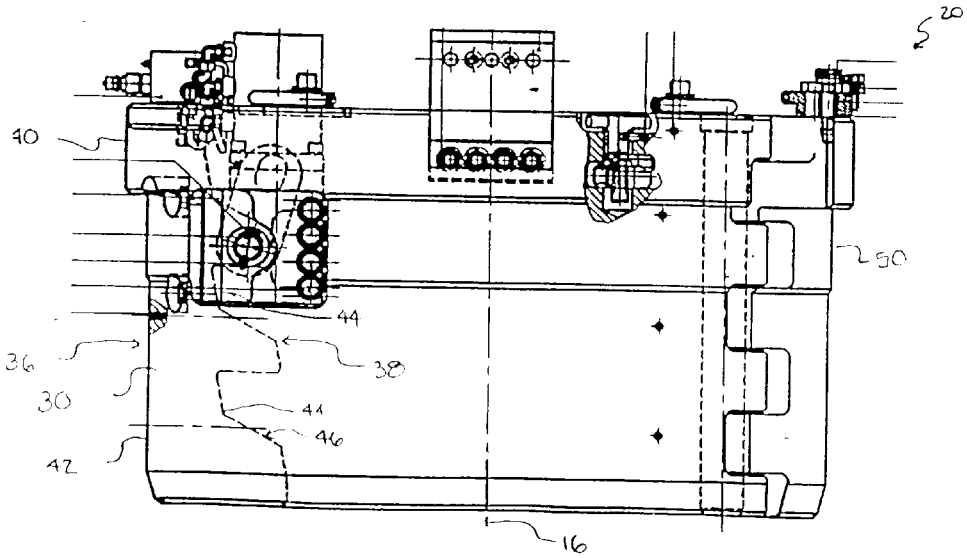
FIG. 3 is a cross-sectional side view of the slip bowl of FIG. 2, taken in the direction of line 3—3 of FIG. 2.

With reference to FIGS. 2 and 3, the slip bowl 20 comprises an arc or C-shaped section 30, which forms a semi-circular partially enclosed annular body. The slip bowl is preferably cast from an alloy or low alloy steel, such as CMS 02 grade 150-135 steel, or more preferably CMS 01 steel, or most preferred, CMS 02 grade 135-125 steel. The section further includes an annular outer surface 36 and an upwardly tapered inner surface 38. The section is symmetric about a vertical axis 16 to form a central bore 35 for receiving the slip assembly 22 (FIG. 1).

Externally, the outer surface 36 of the body section 30 is defined by a cylindrical shoulder 40 that outwardly extends from an upper portion of the section and a complementary, reduced diameter outer cylindrical surface 42. As shown in FIG. 1, the complementary outer surface 42 is received and confined within the central opening 18 and the shoulder 40 is received by a recess 17 in the central opening 18 and abuts a rotary table shoulder 15, such that the slip bowl 20 is effectively supported in the rotary table 12.

Referring back to FIG. 3, internally, the tapered inner surface 38 of the slip bowl sections are corrugated to form a plurality of grooves 44 that extend into the central bore 35. The tapered inner surface 38 and the grooves 44 together define a tapered contact surface 46 of the slip bowl 20 for receiving and engaging the outer surface of the slip assembly 22. The grooves 44 are configured to allow the slip assembly 22 to recess into the slip bowl 20 such that the slip assembly 22 occupies a smaller amount of the central bore 35, thus allowing for a larger clearance for the drill string 14 within the slip assembly 22 when the slip assembly 22 is in an "open" position, as defined below.

Referring to FIG. 2, the partially enclosed annular body section 30 has a pair of hydraulic actuators 48 mounted on opposite sides of the body 30, which raise the slip assembly 22 between the "open" position and a "closed" position. In the open position, the slip assembly 22 is raised to receive the drill string 14 within the central bore 35. In the "closed" position, the slip assembly 22 is lowered to grip the drill string 14 within the central bore 35 of the slip bowl 20. An arc-shaped door 50 is removably coupled between open ends of the body section 30 of the slip bowl 20 to fully enclose the body and form an enclosed annular body that retains the slip assembly 22.

Figure 4:
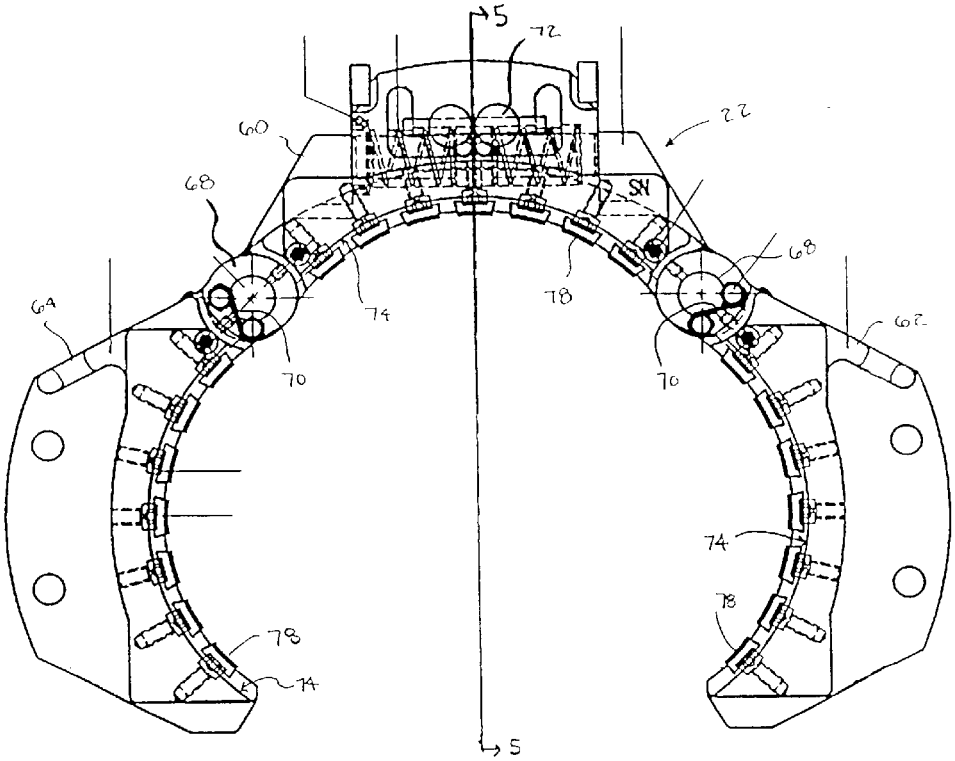
FIG. 4 is a top view of a slip assembly of the power slip system in FIG. 1 shown in an "open" position.
Figure 5:
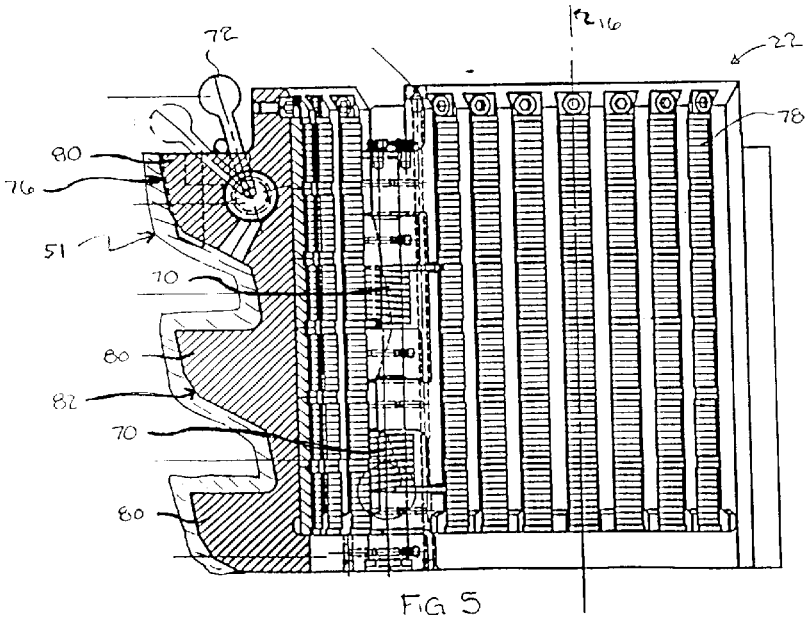
FIG. 5 is a cross-sectional side view of the slip assembly of FIG. 4, taken in the direction of line 5—5 of FIG. 4.
Figure 6:
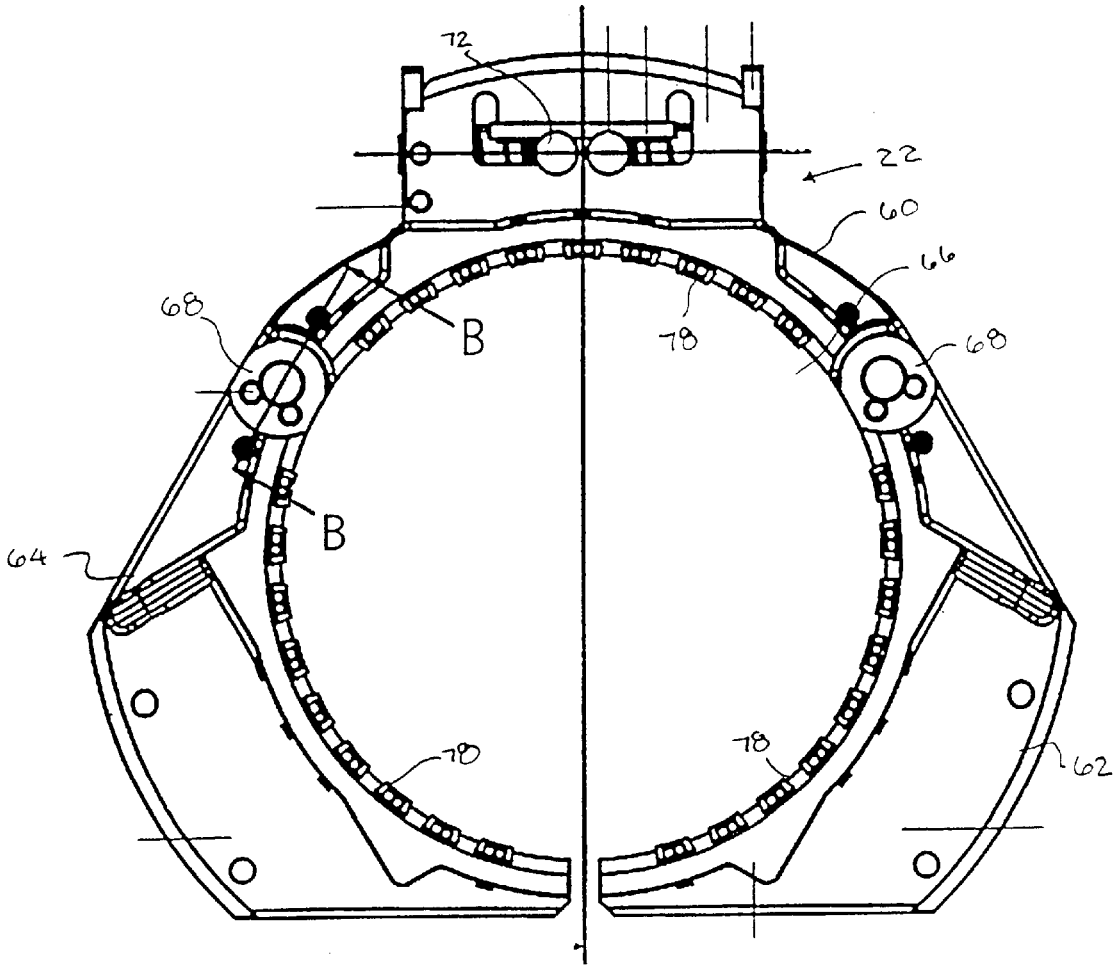
FIG. 6 is a top view of a slip assembly of the power slip system in FIG. 1 shown in an "closed" position.

Referring to FIGS. 4 to 6, in a preferred embodiment, the slip assembly 22 comprises a generally annular body formed by a center slip segment 60, a left hand slip segment 62 and a right hand slip segment 64. However, although three slip segments are shown, the slip assembly 22 may comprise any number of slip segments. The slip segments are symmetrically disposed about the vertical axis 16 (FIG. 5) to form an orifice 66 (FIG. 6) for receiving the drill string. The slip segments are preferably cast from CMS 02 grade 150-135 steel, or more preferably, CMS 01 steel. The left and right hand slip segments 62 and 64 are hinged at opposite ends of the center slip segment 60 by a pair of hinge pins 68. The free ends of the left and right hand slip segments 62 and 64 are biased away from each other, i.e. towards the "open" position, by use of hinge springs 70 (FIG. 5). The slip assembly 22 also includes a handle 72, which may be coupled to the center slip segment 60. The handle 72 locks the left and right hand slip segments 62 and 64 into engagement with the actuators 48 (FIG. 2), which force the slip segment against the spring bias and to the "closed" position (as shown in FIG. 6) or retain the free ends of the left and right slip segments in abutment to form an enclosed annular structure.

Each slip segment has an arcuate body shape defined by a radial interior surface 74 and a downwardly tapered exterior surface 76. The interior surface 74 of the slip segments are adapted to receive a set of inserts 78 that extend essentially circumferentially about the orifice 66 to grip and support the drill string 14. The inserts 78 preferably have external teeth for assuring effective gripping engagement with the drill string 14.

The downwardly tapered exterior surface 76 of each slip segment is corrugated to form a plurality of fingers 80 that outwardly extend from the body of each slip segment and are configured to mate with the slip bowl grooves 44. The downwardly tapered exterior surface 76 and the fingers 80 together define a tapered contact surface 82 of each slip segment, wherein the tapered contact surface 82 of each slip segment is adapted to engage the inner contact surface 42 of the slip bowl 20. The fingers 80 engage the slip bowl grooves 44 to retain each slip segment from lateral movement with the slip bowl 20. Under normal drilling conditions, the slip assembly 22 is required to support lateral loads of about 1 ton to about 750 tons.

Since cold welding between the slip assembly 22 and the slip bowl 20 can be caused by casting the slip segments and the slip bowl 20 from similar steel materials, it is desirable that either the slip segments or the slip bowl 20 is cast from a material that is dissimilar to steel. Such a material should have little or no tendency to dissolve into the atom structure of steel. However, casting the slip segments or the slip bowl from a material other than that of steel requires specialized hardware and is expensive to fabricate. Thus, another solution to prevent cold welding between the slip assembly 22 and the slip bowl 20 is to fabricate the slip segments and the slip bowl 20 from a steel material and to coat or plate either the contact surface 46 of the steel slip bowl 20 (FIG. 3) or the contact surface 82 of the steel slip assembly 22 with the material 51 (FIG. 5) that is dissimilar to steel and has little or no tendency to dissolve into the atom structure of steel. Although, for clarity, the following description describes attaching the material 51 to the contact surface 82 of each slip segment of the slip assembly 22, the material 51 may alternatively be attached to the contact surface 46 of the slip bowl 20 by any of the methods described below.

The material 51 may comprise any non-steel metallic material, such as Copper (Cu) based materials. For example, in one embodiment the material 51 is a metallic layer of a bronze alloy (NiAlCu) having a composition of approximately 13.5% Al (Aluminum), approximately 4.8% Ni (Nickel), approximately 1.0% Mn (Manganese), approximately 2.0% Fe (Iron) and approximately 78.7% Cu (Copper). In alternative embodiments, the material 51 may comprise Tungsten Carbide, Molybdenum, or any other metal in the nickel, aluminum or bronze family.

The material 51 may be applied or assembled to the tapered contact surfaces 82 of each slip segment by any suitable technique. In a preferred process, the material 51 is applied to each slip segment by MIG (Metal Inert Gas) welding with an argon shield. This may be accomplished by the use of a pulse machine by manual application or automatic or sub-arc welding and extra welder protection, such as a gas exhaust system, may be utilized to protect the welder from the toxic gas developed during welding. An alternative process of cold wire TIG (Tungsten Insert Gas) welding may also be used to apply the material 51 to the tapered contact surfaces 82 of each slip segment.

In one embodiment, before applying the material 51, the slip segments are pre-heated to a temperature in a range of approximately 250° C. to approximately 400° C. to prevent cracking of the material 51 during cool down. For example, in one embodiment the slip segments may be pre-heated to a temperature of approximately 250° C., and more preferably to a temperature of about 350° C. The material 51, preferably about ⅛ inches thick, may be welded to the contact surfaces 82 of the slip segments with wire 402 (390–410 HB), or more preferably with a softer wire type 302 (300–320 HB) applying a current of about 150A to about 350A and a voltage of about 25V to about 30V.

In an alternative embodiment, the material 51 may be applied by an electric thermal spray, a metal flame spray method or another similar coating method. For example, the slip surfaces 82 may be coated with 400 HB (Brinell Hardness) NiAlCu, which provides a hardness of approximately 43 HRC (Rockwell Hardness C Scale) after application, or more preferably the slip surfaces 82 may be coated with 300 HB NiAlCu, which provides a hardness of approximately 32 HRC after application. After application, the slip segments may be turned on a mandrel and machined to a thickness in a range of approximately ¼ inches to 1/16 inches, preferably approximately 0.08 inches (2 mm). In one embodiment, the material is turned until the material hardness is in a range of approximately 35 to about approximately 56 HRC.

During the turning operation, the slip segments acquire a very smooth final machine surface which will require little buffing afterwards. For example in one embodiment, after final turning, the contact surfaces of the slip segment have close to a mirror finish (i.e. close to the same finish as polished steel), such as a surface finish in a range of approximately 8 to approximately 64. During the application process, the material 51 may be added using a common fabrication process. Thus, not only are the initial fabrication costs minimized, but the slips may be easily repaired in conventional facilities.

In one embodiment, the material 51 is mechanically attached to the contact surface 82 of each slip segment, such as by use of screw fasteners or the like.

In any of the above embodiments, one or both of the slip bowl and the slip segment may be carburized to harden the slip bowl or the slip segment material, respectively. Any of the above embodiments may also comprise more than one layer of the material 51.

As discussed above, although the material 51 has been described as being attached to the contact surface 82 of each slip segment, the material 51 may alternatively be attached to the contact surface 46 of the slip bowl 20 by any of the methods described above.

In accordance with the present invention, sticking between the slip assembly 22 and the slip bowl 20 is minimized. As a result, static friction between slip segments and slip bowl 20 is reduced, enabling the slip assembly 22 to self-release from the slip bowl 20 after an axial load from the drill string 14 to the slip assembly 22 is released. Accordingly, the attachment of the material 51, being comprised of a material that is different from the material of the slip assembly 22 and the slip bowl 20, to either the slip assembly 22 or the slip bowl 20 reduces cold welding between the stationary slip assembly 22 and the rotating slip bowl 20.

The present invention also provides the advantage of non-lubricated or greaseless slips. Thus, the relatively large expense of providing large quantities of lubrication or grease between the slip assembly and the slip bowl to prevent the slip assembly from sticking to the slip bowl during the drilling is replaced by the relatively inexpensive means of the present invention, which is also safe for the environment It should be understood that the embodiments described and illustrated herein are illustrative only, and are not to be considered as limitations upon the scope of the present invention. Variations and modifications may be made in accordance with the spirit and scope of the present invention. It is understood that the scope of the present invention could similarly encompass other materials that are dissimilar to steel. The method of the present invention may be used to control and repair wear on surfaces of big steel machines and other similar wear components. Therefore, the invention is intended to be defined not by the specific features of the preferred embodiments as disclosed, but by the scope of the following claims.

What is claimed is:

1. An oil or gas well slip system comprising:

a slip bowl having an interactive contact surface;

a slip assembly having a mating interactive contact surface for slidable engagement with the slip bowl interactive contact surface, wherein the slip bowl and the slip assembly are each comprised of a first material; and a second material attached to the interactive contact surface of either the slip bowl or the slip assembly, wherein the second material is compositionally different from the first material to prevent cold welding between the slip bowl and the slip assembly and wherein the second material has little or no tendency to dissolve into the atomic structure of the first material.

2. The slip system of claim 1, wherein the first material is comprised of steel and the second material is comprised of a non-steel metallic material.

3. The slip system of claim 2, wherein the non-steel metallic material is chosen from the group consisting of copper alloys, bronze alloys, nickel alloys and aluminum alloys.

4. The slip system of claim 2, wherein the non-steel metallic material has a hardness in a range of 35 to 56 Rockwell Hardness C Scale.

5. The slip system of claim 2, wherein the slip assembly comprises a plurality of fingers that engage a plurality of grooves in the slip bowl to prevent a lateral movement of the slip assembly with respect to the slip bowl while allowing for a rotational movement of the slip assembly with respect to the slip bowl.

6. The slip system of claim 2, wherein the non-steel metallic material has a thickness in a range of ¼ to 1/16 inches.

7. The slip system of claim 2, wherein the non-steel metallic material is a coating that is attached to the interactive contact surface of either the slip bowl or the slip assembly.

8. The slip system of claim 2, wherein the non-steel metallic material is a welded to the interactive contact surface of either the slip bowl or the slip assembly.

9. The slip system of claim 2, wherein the non-steel metallic material is a attached to the interactive contact surface of either the slip bowl or the slip assembly by a mechanical fastening means.

10. A method of reducing cold welding between a slip assembly and slip bowl of an oil or gas well slip system comprising:

providing a slip bowl having an interactive contact surface;

providing a slip assembly having a mating interactive contact surface for slidable engagement with the slip bowl interactive contact surface, wherein the slip bowl and the slip assembly are each comprised of a first material; and attaching a second material to the interactive contact surface of either the slip bowl or the slip assembly, wherein the second material is compositionally different from the first material to prevent cold welding between the slip bowl and the slip assembly and wherein the second material has little or no tendency to dissolve into the atomic structure of the first material.

11. The slip system of claim 10, wherein the first material is comprised of steel and the second material is comprised of a non-steel metallic material.

12. The slip system of claim 11, wherein the non-steel metallic material is chosen from the group consisting of copper alloys, bronze alloys, nickel alloys and aluminum alloys.

13. The slip system of claim 11, wherein the non-steel metallic material has a hardness in a range of 35 to 56 HRC.

14. The slip system of claim 11, further comprising forming a plurality grooves in the slip bowl and forming a plurality of mating fingers in the slip assembly that engage the slip bowl grooves to prevent a lateral movement of the slip assembly with respect to the slip bowl while allowing for a rotational movement of the slip assembly with respect to the slip bowl.

15. The slip system of claim 11, wherein the non-steel metallic material has a thickness in a range of ¼ to 1/16 inches.

16. The slip system of claim 11, wherein attaching the non-steel metallic material comprises coating the non-steel metallic material to the interactive contact surface of either the slip bowl or the slip assembly.

17. The slip system of claim 11, wherein attaching the non-steel metallic material comprises welding the non-steel metallic material to the interactive contact surface of either the slip bowl or the slip assembly.

18. The slip system of claim 11, wherein attaching the non-steel metallic material comprises attaching a mechanical fastening means to the non-steel metallic material and to the interactive contact surface of either the slip bowl or the slip assembly.

* * * * *